US008914929B2

(12) United States Patent
Hanlon

(10) Patent No.: US 8,914,929 B2
(45) Date of Patent: Dec. 23, 2014

(54) MULTIFUNCTION TOOL FOR DEMOLITION

(75) Inventor: Jared Hanlon, Santa Clarita, CA (US)

(73) Assignee: Pull'r Holding Company, LLC, Schaumburg, IL (US)

( * ) Notice: Subject to any disclaimer, the term of this patent is extended or adjusted under 35 U.S.C. 154(b) by 0 days.

(21) Appl. No.: 12/658,472

(22) Filed: Feb. 9, 2010

(65) Prior Publication Data

US 2010/0186174 A1 Jul. 29, 2010

Related U.S. Application Data

(63) Continuation of application No. 12/151,341, filed on May 5, 2008, now abandoned.

(51) Int. Cl.

| | |
|---|---|
| ***B25B 13/48*** | (2006.01) |
| ***B25F 1/00*** | (2006.01) |
| ***B25D 1/00*** | (2006.01) |
| ***B25B 13/04*** | (2006.01) |
| ***E04G 23/08*** | (2006.01) |

(52) U.S. Cl.

CPC . *B25B 13/04* (2013.01); *B25F 1/00* (2013.01); *E04G 23/08* (2013.01)

USPC ..... 7/144; 7/147

(58) Field of Classification Search

USPC ..... 7/143–147, 138, 158, 166; 81/20; D8/75, 78, 81

See application file for complete search history.

(56) References Cited

U.S. PATENT DOCUMENTS

| | | | | | |
|---|---|---|---|---|---|
| 592,077 | A | * | 10/1897 | Burkhalter | 7/134 |
| 868,733 | A | * | 10/1907 | Walker | 7/138 |
| 1,465,009 | A | * | 8/1923 | Wasseth | 81/437 |
| 1,472,517 | A | * | 10/1923 | Fry | 81/120 |
| 1,773,931 | A | * | 8/1930 | Ayvad | 7/145 |
| 2,597,876 | A | * | 5/1952 | Kurkjian | 81/23 |
| 2,627,078 | A | * | 2/1953 | Eliot | 7/138 |
| 3,623,173 | A | * | 11/1971 | Hagqvist | 7/145 |
| 4,242,780 | A | * | 1/1981 | Littman | 29/81.17 |
| D281,216 | S | * | 11/1985 | Cutliff et al. | D8/26 |
| 4,597,123 | A | * | 7/1986 | Cobe, Jr. | 7/138 |
| 5,247,715 | A | * | 9/1993 | Nishiguchi | 7/138 |
| 6,598,858 | B2 | * | 7/2003 | Santa Cruz et al. | 254/26 R |
| D499,322 | S | * | 12/2004 | Hung | D8/81 |
| D507,167 | S | * | 7/2005 | Richardson | D8/81 |
| D525,506 | S | * | 7/2006 | Downing, Jr. | D8/78 |
| 7,107,880 | B2 | * | 9/2006 | Kitchen et al. | 81/176.1 |
| 7,367,545 | B1 | * | 5/2008 | Chen | 254/25 |
| 2003/0192129 | A1 | * | 10/2003 | Foley | 7/144 |
| 2007/0226913 | A1 | * | 10/2007 | Woolley et al. | 7/146 |
| 2008/0072713 | A1 | * | 3/2008 | Chen | 81/46 |
| 2009/0000039 | A1 | * | 1/2009 | St. John et al. | 7/138 |

* cited by examiner

*Primary Examiner* — Robert Scruggs

(74) *Attorney, Agent, or Firm* — Cherskov Flaynik & Gurda, LLC

(57) ABSTRACT

A multi-function tool having a handle portion and a plurality of structures operable therewith for the performance of a plurality of functions. The multi-function tool allows fast and convenient transition between any of the plurality of functions in order to enable completion of jobs or tasks requiring such functions without acquisition, storage, and/or maintenance of a plurality of specialized tools.

11 Claims, 2 Drawing Sheets

MULTIFUNCTION TOOL FOR DEMOLITION

CROSS REFERENCE TO RELATED APPLICATIONS

This application claims the priority benefit as a continuation of U.S. Utility application Ser. No. 12/151,341, filed on May 5, 2008, presently pending.

BACKGROUND OF THE INVENTION

1. Field of the Invention

The present disclosure relates generally to hand tools, and, more particularly, to a multi-function tool suitable for various demolition tasks.

2. Background of the Invention.

Many construction or building projects, including demolition tasks, require a plurality of functions for proper completion. Accordingly, numerous specialized tools are frequently needed to perform specific respective functions. For large or complex jobs, the acquisition, storage, and/or maintenance of a large number of specialized tools required may become burdensome and/or expensive.

In order to alleviate such burden and to reduce such cost, multi-function tools have been designed to allow a single tool to perform two or more tasks. The specific functionality selected for a multi-function tool is typically selected to allow performance of tasks or functions that are commonly necessary to complete a single project. For example, the common roofing project of shingling frequently requires both a striking function to drive nails, as well as a cutting function to adjust shingle size. Accordingly, hammers having a striking surface and cutting means have been developed and employed to make performance of both functions more convenient. Unfortunately, the number of such multi-function tools is limited, typically to jobs or projects that require relatively few functions, such as two or three. For many projects, however, many more functions are necessary, even if infrequently, and thus require numerous specialized tools, including one or more of multi-function tool(s).

Thus, it is clear that there is an unmet need for a multi-function tool that conveniently enables performance of a greater number of functions, whereby the number of specialized tools required to complete a large or complex job may be reduced, preferably to a single tool, and whereby the need for storage and carriage of a large number of tools may be reduced or eliminated.

SUMMARY OF INVENTION

Briefly described, in an exemplary embodiment, the multi-function tool of the present disclosure overcomes the above-mentioned disadvantages and meets the recognized need for such a tool by providing a multi-function tool providing a hammer function, a first-class lever function, a second-class lever function, a chisel function, an axe function, a wrench function, and a scoring function, among others.

More specifically, the exemplary multi-function tool includes a generally extended handle portion, such as in the form of a bar or shaft, and a plurality of structures associated therewith, each structure configured and arranged to enable performance of at least one function or task. The handle portion preferably includes a grip for comfortable secure grasping and manipulation. The handle portion further preferably terminates at a first end in a chisel point or blade, whereby the handle portion may be used to drive the chisel point or blade, such as for chiseling, chipping, gouging, or puncturing, or to manipulate the point or blade, such as for scoring or cutting. A wrench structure may additionally be included proximate the first end, whereby nuts, bolts, or other threaded fasteners, or the like, may be adjusted. Furthermore, a nail or other fastener removing structure may be included proximate the first end, such as a second-class lever nail puller.

A hammer head is preferably included on a second end of the handle portion having a striking face radially spaced from a longitudinal axis of the handle portion in a first direction. The striking face may be smooth or textured, such as having a waffle pattern. A claw is preferably also included on the second end of the handle portion extending generally radially from the longitudinal axis of the handle portion in a second direction. The claw portion may be configured for use in prying a first-class lever, including for pulling nails, or the like, and may additionally include chisel blades, or the like, for chipping or chiseling. An axe blade is preferably further included proximate the second end of the handle, such as formed over a lateral edge of the side handle, preferably at a transition between the handle portion or grip proximate the hammer head and/or the claw. The axe blade may enable a cutting and/or chopping function.

The second end of the handle portion may optionally further be provided with a slot adapted to receive a member, such as a piece of dimensional lumber, or the like, whereby the handle portion may be used to wrench or lever the member. The slot may include a varying dimension or a plurality of slots having different dimensions may be provided in order to accommodate members having different dimensions. Additionally, teeth or other textured gripping structures or surfaces may be included to ensure secure gripping of the member in the slot.

Generally, the exemplary multi-function tool is configured such that any enabled function may be performed without interference from structures of the tool that enable different functionality without reconfiguration or other manipulation. Accordingly, the tool need not be adjusted in order to accomplish any function, whereby transition between performance of various functions may be accomplished quickly and conveniently. Furthermore, the configuration of the tool is preferably selected to at least partially imitate the general configuration of known tools, such as the overall configuration of a hammer, whereby the tool may be used with conventional accessories, such as a toolbox or case, a tool belt, or the like.

Accordingly, one feature and advantage of the tool of the present disclosure is its ability to provide a tool useful for the performance of a plurality of different tasks whereby acquisition, storage, and/or maintenance of a plurality of task-specific tools may be avoided.

Another feature and advantage of the present tool is its ability to enable quick and convenient transition between the performance of different one of a plurality of various functions.

These and other features and advantages of the tool of the present disclosure will become more apparent to those ordinarily skilled in the art after reading the following Detailed Description of the Invention and Claims in light of the accompanying drawing Figures.

BRIEF DESCRIPTION OF DRAWING

Accordingly, the present disclosure will be understood best through consideration of, and with reference to, the following drawings, viewed in conjunction with the Detailed Description of the Invention referring thereto, in which like reference numbers throughout the various drawings designate like structure, and in which.

Figure 1:
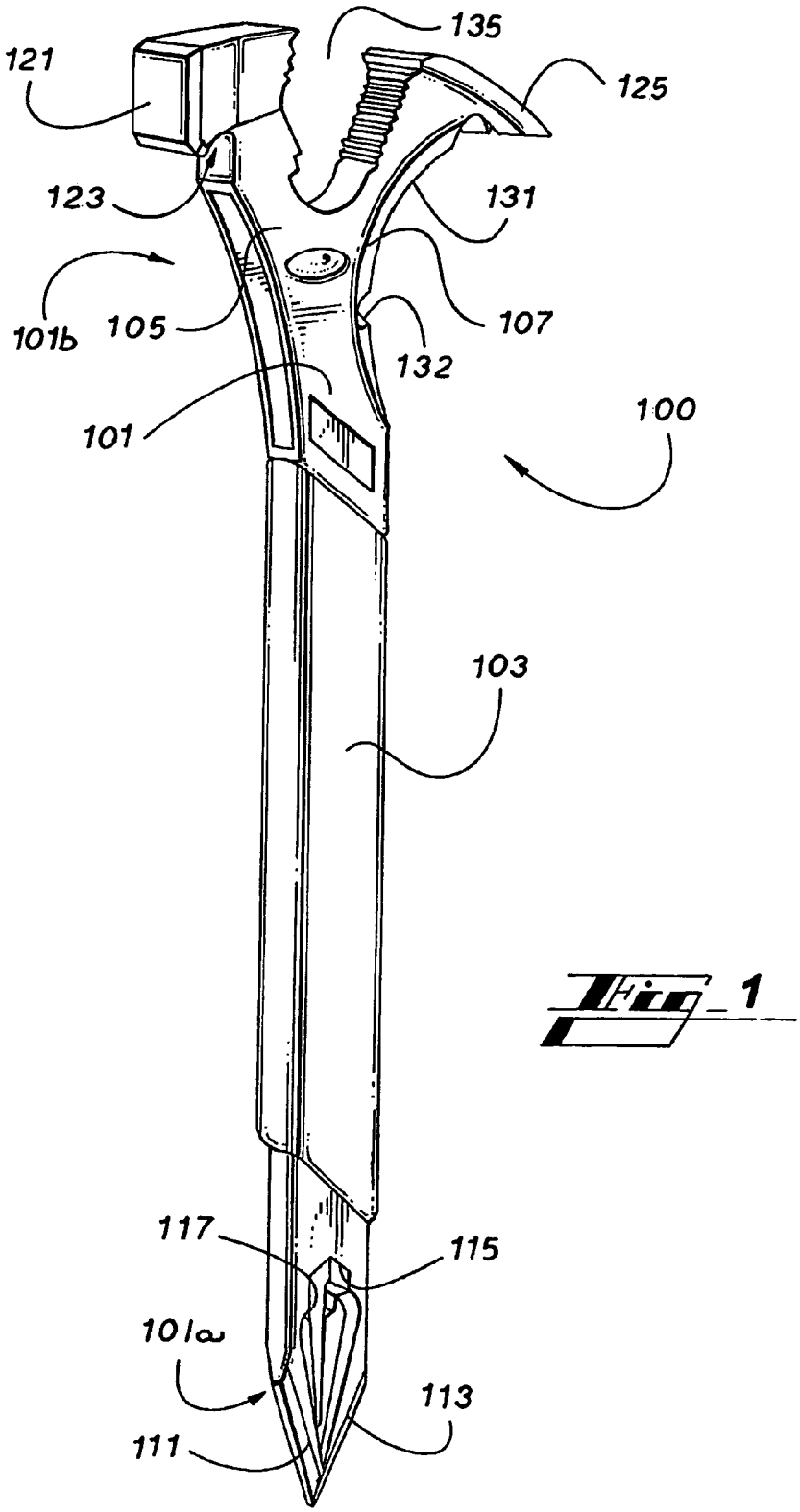
FIG. 1 is a perspective view of a multi-function tool.

It is to be noted that the drawings presented are intended solely for the purpose of illustration and that they are, therefore, neither desired nor intended to limit the scope of the disclosure to any or all of the exact details of construction shown, except insofar as they may be deemed essential to the claimed invention.

DETAILED DESCRIPTION OF THE INVENTION

In describing exemplary embodiments of the tool of the present disclosure illustrated in the drawings, specific terminology is employed for the sake of clarity. The invention, however, is not intended to be limited to the specific terminology so selected, and it is to be understood that each specific element includes all technical equivalents that operate in a similar manner to accomplish a similar purpose.

Figures 2, 3:
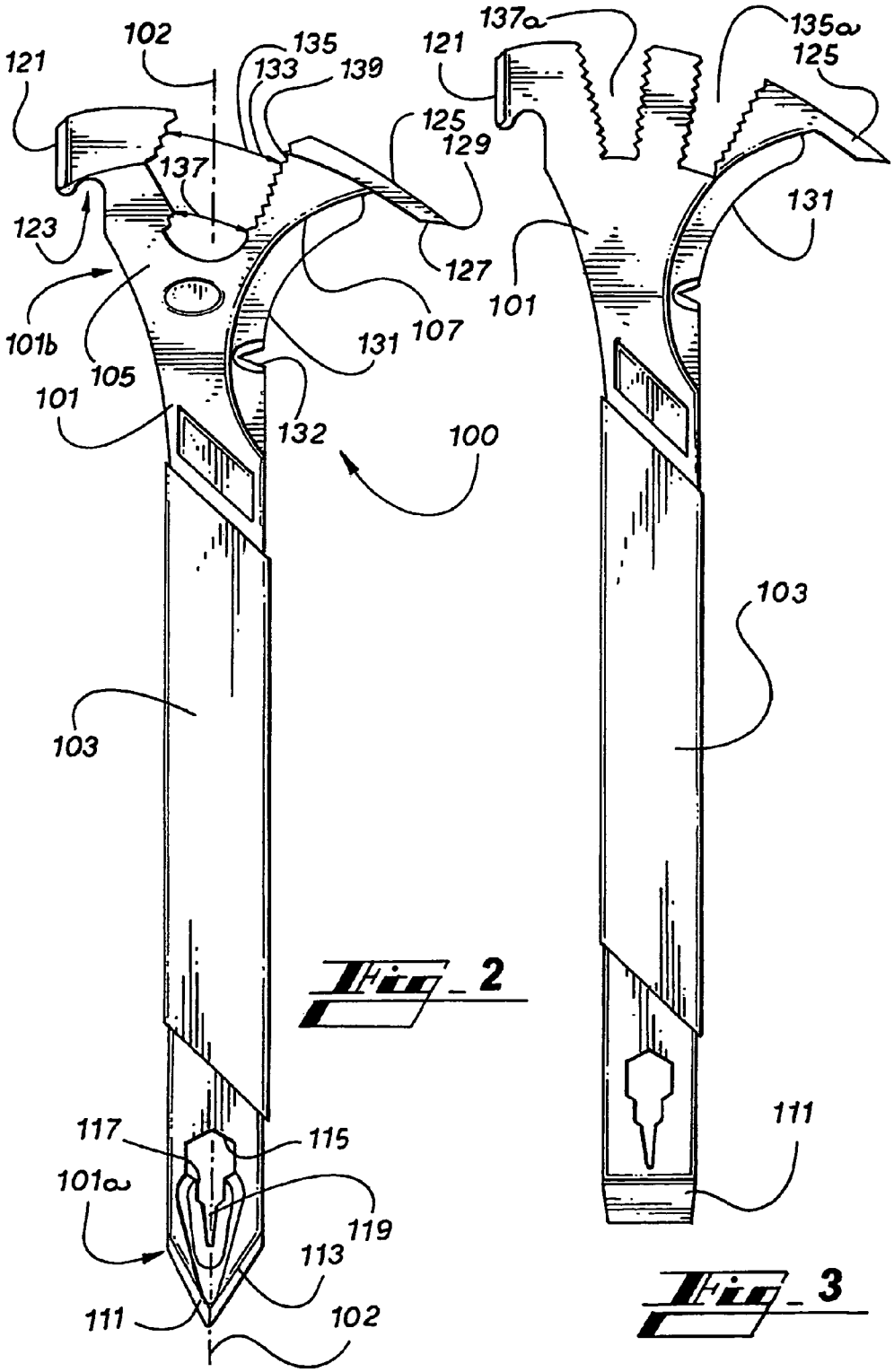
FIG. 2 is a side view of the tool of FIG. 1.
FIG. 3 is a side view of a multi-function tool according to an alternative configuration.

In that form of the tool of the present disclosure chosen for purposes of illustration, FIGS. 1 and 2 show tool 100 including body 101 and grip 103. Body 101 is preferably formed as a monolithic or unitary member from a suitable metal, composite, or synthetic material, or the like and includes grip 103 formed or installed thereon. Grip 103 may be formed from natural or synthetic rubber, plastic, composite, or the like, and may be resilient and/or sculptured or contoured to provide a comfortable and secure grasping surface. Grip 103 is preferably disposed proximate a medial portion of body 101 along longitudinal axis 102. Body 101 preferably includes first end 101*a* and second end 101*b* each extending beyond grip 103, and each preferably carrying or including at least one structure adapted to enable at least one associated function.

For example, and as illustrated best in FIG. 2, first end 101*a* preferably includes chisel 111 and/or blade 113. Additionally, first end 101*a* may include first and second wrench apertures 115 and 117, respectively, adapted to engage nuts, bolts, or the like, of different sizes. Slot 119 may further be included for prying nails or the like. As will be understood by those ordinarily skilled in the art, the sizes, shapes, or other configuration parameters selected for each of chisel 111, blade 113, wrench apertures 115 and 117, and/or slot 119 may be selected as desired, such as for use with commonly found fasteners, materials, or tasks. For example, chisel 111 may be formed as a pointed member, as illustrated in FIG. 2 or as a flat member, as illustrated in FIG. 3, depending on a material with which tool 100 is intended to be used. Similarly, the sizes and configurations of wrench apertures 115 and 117, e.g. half inch hex pattern, may be selected as desired. As will further be understood by those ordinarily skilled in the art, first end 101*a* may include additional and/or alternative structures to enable additional and/or alternative functions, such as a Phillips or flat head screwdriver bit, a saw blade, a rasp surface, wire stripping slots, an awl, or the like.

Second end 101*b* preferably includes a generally V-shape having first projection 105 and second projection 107. First projection 105 preferably includes hammer head 121 disposed or formed generally at a distal end thereof and spaced radially from longitudinal axis 102. Hammer head 121 may include a smooth or textured face and is preferably configured and arranged for at least one of driving fasteners, breaking objects, or moving objects. Accordingly, first projection 105 is preferably configured to withstand repeated substantial impact forces without failure. Hammer head 121 and/or first projection 105 may additionally include one or more structures, such as a magnetic nail holder, bottle opener 123, or the like. Second projection 107 is preferably arranged opposite first projection 105 and includes claw 125 extending away from longitudinal axis 102. Claw 125 may include slot 127 for pulling nails, or the like, and/or at least one blade 129 for use in chipping, chiseling, or prying. Second projection 107 preferably further includes blade 131 formed over a length of an edge portion thereof. Blade 131 may be used for cutting, splitting, chopping, or the like, and may optionally include notch 132 for use in pulling nails, cutting or stripping wire, or the like. Accordingly, and similar to first projection 105, second projection 107 is preferably adapted to withstand repeated impact forces without failure.

Additionally, second end 101*b* preferably further includes at least one open-ended slot 133 between first and second projections 105 and 107. As illustrated in FIG. 2, slot 133 includes a first wider portion 135 and a second narrower portion 137. Teeth 139 or other texture or friction surface is preferably provided on portions of second end 101*b* proximate slot 133, or at least one or more portion thereof, for enabling secure gripping engagement of tool 100 with a board or other member disposed within slot 133. As will be understood by those skilled in the art, the sizes of wider portion 135 and narrower portion 137 may be selected to accommodate different sizes of dimensional lumber, metal studs, plywood, engineered lumber, composite members, or the like typically found or used in construction or demolition projects. As will further be understood by those ordinarily skilled in the art, wider portion 135 and narrower portion 137 of slot 133 may be replaced by separate slots 135*a* and 137*a*, as illustrated in FIG. 3, wherein one or more of slots 135*a* and 137*a* may include varying or different dimension portions.

In use, tool 100 may be used to perform many different functions necessary for a selected job or task. For example, with regard to a demolition task, tool 100 may be used as a hammer wherein a user may hold tool 100 by grip 103 and swing second end 101*b* to strike a desired object with hammer head 121. Such striking may be useful in demolishing tile, masonry, metal, and/or wood structures, among others. When removing tile, hammer head 121 may be used to break a tile to remove it. Once the tile is removed, adjacent tiles may easily be removed by driving chisel 111 or blade 129 beneath the tile, whereby the tile may be pried loose either by a leverage action or by an increasing dimension of chisel 111 or blade 129. Specifically, chisel 111 may be used as a second-class lever wherein the tip of chisel 111 acts as the fulcrum and wherein force is applied to grip 113 and/or second end 101*b*. Claw 125, however, may be used as a first-class lever wherein force is applied to grip 103 and/or first end 101*a* and wherein a curved surface of claw 125 acts as a fulcrum to move blade 129.

When desired tiles have been removed, tool 100 may further be employed to open a wall or floor to which the tiles were previously attached by striking with hammer head 121 blade 129, blade 131, and/or chisel 111. Enclosed wires, pipes, or other conduits may likewise be demolished or removed by chopping with blade 131 or by striking with hammer head 121. Structural members such as studs, beams, joists, or the like, may be removed by striking with hammer head 121 and/or by wrenching or torquing such members via grip 103 and/or first end 101*a* and slot 133. Nails or other fasteners projecting from removed members or remaining structures may be removed via slot 127 of claw 125, via slot 119, via notch 132, or may be driven flush or bent flat via striking with hammer head 121. Furthermore, any structures secured via bolts may be removed by disposing a bolt head or nut within a corresponding one of apertures 115 and 117 and by torquing via application of force to second end 101*b* and/or grip 113.

Thus, many different functions may be performed by tool 110 in order to accomplish a task without the need for additional tools. Accordingly, in many instances, tool 100 may be the only tool necessary to complete a selected task or job. As a result, such task or job may be finished more quickly due to the ability of a user to transition between different functions without having to stop, find a different tool, and resume work.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

The embodiment of the invention in which an exclusive property or privilege is claimed is defined as follows:

1. A multi-function demolition tool comprising:

a. a non-moveable monolithic body portion having a body first end and a body second end wherein said body defines a longitudinal axis; and b. a grip portion defined by a medial portion of said body wherein said first end and second end extend beyond the grip portion;

c. wherein tools are integrated into the body only at the first end and the second end and not in the grip portion wherein first end tools are integrated into said body first end and second end tools are integrated into said body second end wherein second end tools comprise a hammer head formed from a first projection of said body second end and a claw defined from a second projection of said body second end wherein said claw comprises a first-class lever, wherein said first projection and said second projection are separated by a slot wherein said slot spans the longitudinal axis of the body, wherein said slot is substantially parallel with the longitudinal axis, wherein said slot comprises a first upper wider portion and a second narrower portion below said upper wider portion, said portions facilitate gripping of a member within said slot, wherein said upper wider portion defines side surfaces wherein said side surfaces comprise teeth wherein said teeth enable the secure gripping engagement of the tool with the member disposed within the slot and wherein said lower narrower portion defines side surfaces wherein said side surfaces do not define teeth and wherein the first projection extends at a first angle with respect to the longitudinal axis, and the second projection extends at a second angle with respect to the longitudinal axis wherein the first angle and the second form a v-shape wherein the interior of the v-shape defines gripping surfaces and wherein board gripping portions of opposing interior surfaces of the slot are substantially parallel and wherein planes extending from the defined gripping surfaces do not intersect and remain substantially parallel; wherein first end tools comprise a chisel wherein said chisel comprises a second-class lever.

2. The demolition tool of claim 1 wherein a grip material encapsulates the grip portion wherein said material is formed from natural or synthetic rubber, plastic, or composite.

3. The demolition tool of claim 1 wherein the body first end and body second end extends beyond the grip.

4. The demolition tool of claim 3 wherein first end tools integrated into said body first end comprise one or more wrench apertures, a chisel, and a blade.

5. The demolition tool of claim 4 wherein the chisel comprises a pointed member.

6. The demolition tool of claim 3 wherein the first end tools comprise three wrench apertures and a chisel comprises a flat member.

7. The demolition tool of claim 1 wherein the first projection further defines a magnetic nail holder as part of the first projection.

8. The demolition tool of claim 1 wherein the first projection further defines a bottle opener wherein said bottle opener is formed from the first projection.

9. The demolition tool of claim 1 wherein the second projection forms a claw extending away from the longitudinal axis formed by the monolithic body.

10. The demolition tool of claim 1 wherein the second projection defines a projection blade extending the length of an edge of the second projection wherein the projection blade is adapted for chipping, chiseling, or prying and wherein said blade comprises a notch wherein said blade is not defined within the claw defined by the second projection.

11. The demolition tool of claim 1 wherein side walls of the slot contain a friction surface.

* * * * *